United States Patent [19]

Herklotz et al.

[11] Patent Number: 4,491,507

[45] Date of Patent: Jan. 1, 1985

[54] GALVANIC DEPOSITING OF PALLADIUM COATINGS

[75] Inventors: Günter Herklotz, Bruchköbel; Gerhard Arnold, Hanau, both of Fed. Rep. of Germany

[73] Assignee: W. C. Heraeus GmbH, Hanau am Main, Fed. Rep. of Germany

[21] Appl. No.: 608,475

[22] Filed: May 9, 1984

[30] Foreign Application Priority Data

May 13, 1983 [DE] Fed. Rep. of Germany ..... 3317493

[51] Int. Cl.[3] ..... C25D 3/52

[52] U.S. Cl. ..... 204/47

[58] Field of Search ..... 204/47, 44.6, 109, 123

[56] References Cited

U.S. PATENT DOCUMENTS

| | | | |
|---|---|---|---|
| 3,458,409 | 7/1969 | Hayashi et al. | 204/47 X |
| 3,544,435 | 1/1970 | Angus et al. | 204/47 |

FOREIGN PATENT DOCUMENTS

| | | | |
|---|---|---|---|
| 1473425 | 2/1967 | France | 204/47 |
| 2065175 | 6/1981 | United Kingdom | 204/47 |

*Primary Examiner*—G. L. Kaplan

*Attorney, Agent, or Firm*—Felfe & Lynch

[57] ABSTRACT

Bright palladium coatings which are pore-free and free of fissures and have a low internal stress are produced by galvanic depositing from a bath which contains tetrammine palladium dibromide, ammonium bromide, sulfamic acid and/or ammonium sulfamate and nicotinic acid and/or nicotinamide.

4 Claims, No Drawings

GALVANIC DEPOSITING OF PALLADIUM COATINGS

BACKGROUND OF THE INVENTION

The invention is in an aqueous bath which contains tetrammine palladium dibromide, ammonium bromide and ammonium hydroxide and is useful in the galvanic depositing of palladium coatings.

In *Transactions of the Institute of Metal Finishing,* 1968, Vol. 46, pp. 26 to 31, a description is given of the galvanic depositing of palladium from aqueous solutions containing tetrammine palladium dibromide, ammonium bromide and ammonium hydroxide. The palladium coatings obtained are ductile and have a dull sheen.

German Pat. No. 1,262,722 discloses a bath consisting of an aqueous alkaline-ammoniacal solution of tetrammine palladium dibromide for the galvanic depositing of palladium coatings on electrical contacts.

The bath described in German Offenlegungschrift No. 3,045,968 for the galvanic production of palladium coatings contains diammine palladium dichloride and/or diammine palladium dibromide, sulfamic acid and ammonium chloride, and has a pH of about 6.5 to 10. The coatings are ductile and generally not porous; thinner coatings may be porous.

U.S. Pat. No. 3,458,409 discloses a method of depositing bright palladium from aqueous ammoniacal palladium salt solutions (pH>9.5) containing pyridine, pyridine carboxylic acid or pyridine carboxylic acid amides as bright-finishing agents. To obtain bright palladium coatings of greater thickness, (more than 5 micrometers), the lead salt of ethylene diamine tetracetic acid is added to the bath. Diammine palladium dichloride is named as a palladium salt that is especially suitable for this process.

The problem presented was to find a bath for the galvanic depositing of palladium coatings which would provide firmly adherent, ductile coatings on nickel, nickel alloys, nonferrous metals and their alloys, and which would be not only free of pores and fissures but also bright, with low internal stresses.

SUMMARY OF THE INVENTION

A solution to the problem is achieved in accordance with the invention by using a bath which is characterized in that it contains 5 to 50 g/l of palladium as tetrammine palladium dibromide, 10 to 150 g/l of ammonium bromide, 10 to 150 g/l of sulfamic acid and/or ammonium sulfamate and 1 to 20 g/l of nicotinic acid and/or 0.1 mg/l to 0.5 g/l of niacinamide (nicotinic acid amide) and has a pH of 6.5 to 10.

The pH of the bath is preferably 8 to 9.

Firmly adherent, ductile, bright coatings free of pores and fissures are obtained using the bath of the invention at 20° to 50° C., preferably at room temperature, and at current densities of 0.1 to 20 amperes per square decimeter, in thickness of 0.5 to 10 micrometers, at a high electrolytic efficiency (more than 90%).

The coatings are furthermore distinguished by low internal stress, constant transfer resistance, and low hydrogen incorporation.

Examples of materials which can be coated are brass, copper, copper-beryllium alloys, nickel and nickel alloys.

DESCRIPTION OF PREFERRED EMBODIMENT

In order to explain the invention, a description will be given of a bath in accordance therewith, and, for comparison, known baths, methods for the depositing of palladium coatings therefrom, and the properties of the coatings.

EXAMPLE 1

An aqueous solution is prepared from
15 g/l of palladium, as tetrammine palladium dibromide,
50 g/l of ammonium bromide,
50 g/l of sulfamic acid, and
10 mg/l of niacinamide,
and the pH of this solution is adjusted to 8.7 with ammonium hydroxide.

From this bath, at a temperature of 24° C., palladium coatings of various thicknesses were deposited on beryllium copper stampings at a current density of about 1.8 amperes per square decimeter.

The palladium coatings obtained have, up to a thickness of about 7 micrometers, a brilliant appearance, and are pore-free down to a thickness of 1 micrometer (according to electrographic testing).

EXAMPLE 2 (FOR COMPARISON)

An aqueous solution is prepared from
20 g/l of palladium as diammine palladium dichloride,
50 g/l of ammonium chloride,
50 g/l of sulfamic acid, and
10 mg/l of niacinamide,
and the pH of this solution is adjusted with ammonium hydroxide to 8.7.

Palladium coatings of various thicknesses are deposited from this bath, at a temperature of 24° C. and a current density of 1.8 amperes per square decimeter, on nickel-plated sheet brass.

The palladium coatings obtained are dull.

EXAMPLE 3 (FOR COMPARISON)

An aqueous solution is prepared from
20 g/l of palladium as diammine palladium dibromide,
50 g/l of ammonium chloride,
50 g/l of sulfamic acid, and
10 mg/l of niacinamide,
and the pH of this solution is adjusted with ammonium hydroxide to 8.7.

Palladium coatings of various thicknesses are deposited from this bath, at a temperature of 24° C. and a current density of 1.8 amperes per square decimeter, on nickel-plated brass sheet metal.

The palladium coatings obtained are pore-free beginning at thicknesses of about 2.6 micrometers, and are bright at thicknesses to about 5 micrometers.

EXAMPLE 4

An aqueous solution is prepared from
15 g/l of palladium as a 5% solution of tetrammine palladium dibromide,
50 g/l of ammonium bromide,
50 g/l of sulfamic acid, and
50 g/l of nicotinic acid.

The precipitation formed after the addition of sulfamic acid is dissolved with ammonium hydroxide, the pH value is adjusted to 8.7 with ammonium hydroxide and/or sulfamic acid.

From this bath, at 24° C. and a current density of 1.8 amperes per square decimeter, deposits on previously nickel-plated beryllium copper stampings are obtained, which are bright and insensitive to finger prints, to a coating thickness of about 7 micrometers. The deposits are pore-free beginning at a coating thickness of about 1 micrometer.

The bath of the invention can be regenerated very simply. For this purpose, nicotinic acid or niacinamide, as the case may be, is removed by filtration with active charcoal, and then the content of palladium, conducting salts and buffer salts is made up in any desired manner.

The terms and expressions which have been employed are used as terms of description and not of limitation, and there is no intention in the use of such terms and expressions of excluding any equivalents of the features shown and described or portions thereof, it being recognized that various modifications are possible within the scope of the invention.

With the plating baths described in the examples plating was performed using the article to be coated as cathode and platinized expanded titanium metal as anode. But generally, all kinds of anodes known for palladium plating and being chemically and electrochemically stable at plating conditions are suitable.

We claim:

1. An aqueous bath for the galvanic depositing of palladium coatings, said bath comprising 5–50 g/l of palladium as tetrammine palladium dibromide, 10–150 g/l of ammonium bromide, 10–150 g/l sulfamic acid and/or ammonium sulfamate, and 1–20 g/l of nicotinic acid and/or 0.1 mg/l to 0.5 g/l of niacinamide and has a pH of 6.5–10.

2. The aqueous bath of claim 1, wherein the pH is 8 to 9.

3. A method for the galvanic depositing of palladium coating on an article comprising immersing the article in a bath of 5–50 g/l of palladium as tetrammine palladium dibromide, 10–150 g/l of ammonium bromide, 10–150 g/l sulfamic acid and/or ammonium sulfamate, and 1–20 g/l of nicotinic acid and/or 0.1 mg/l to 0.5 g/l of niacinamide, said bath having a pH of 6.5–10 and a temperature of 20° to 50° C. and applying a current density of 0.1 to 20 amperes per square decimeter.

4. The method of claim 2, wherein the bath pH is 8 to 9.

* * * * *